US005312294A

United States Patent [19]

Meline

[11] Patent Number: 5,312,294

[45] **Date of Patent: *May 17, 1994**

[54] METHOD AND DEVICE FOR MAINTAINING A CLEAN ATMOSPHERE AT CONTROLLED TEMPERATURE AT A WORKSTATION

[75] Inventor: François Meline, Paris, France

[73] Assignee: Societe Generale Pour Les Techniques Nouvelles SGN, En Yvelines, France

[ * ] Notice: The portion of the term of this patent subsequent to Sep. 8, 2009, has been disclaimed.

[21] Appl. No.: 852,152

[22] PCT Filed: Oct. 1, 1990

[86] PCT No.: PCT/FR90/00700

§ 371 Date: Mar. 30, 1992

§ 102(e) Date: Mar. 30, 1992

[87] PCT Pub. No.: WO91/05210

PCT Pub. Date: Apr. 18, 1991

[30] Foreign Application Priority Data

Oct. 2, 1989 [FR] France ..... 89 12861

[51] Int. Cl.[5] ..... F24F 9/00

[52] U.S. Cl. ..... 454/60; 454/190; 454/191

[58] Field of Search ..... 454/49, 56, 57, 58, 454/60, 188, 190, 191, 193

[56] References Cited

U.S. PATENT DOCUMENTS

| | | | |
|---|---|---|---|
| 3,771,323 | 11/1973 | Simons et al. | 454/193 X |
| 4,576,613 | 3/1986 | Miline | 454/66 X |
| 5,145,459 | 9/1992 | Meline et al. | 454/57 |

FOREIGN PATENT DOCUMENTS

| | | | |
|---|---|---|---|
| 1257562 | 2/1961 | France | 454/57 |
| 255528 | 10/1969 | U.S.S.R. | 454/57 |

*Primary Examiner*—Harold Joyce
*Attorney, Agent, or Firm*—Bucknam and Archer

[57] ABSTRACT

A method and device for maintaining a clean atmosphere at controlled temperature, at a workstation accessible from a contaminated room. A curtain of gas—in the form of a slow jet and of a fast jet—is generated at the level of the openings between the workstation and the contaminated zone. The fast jet is situated at the level of the opening on the workstation side; the jets are directed approximately in parallel to the opening so that at least the external face of the fast jet reaches up to the opening. Moreover, a stream of clean gas is generated, and sent in such a way as to create a uniform sweeping, inside the volume to be protected.

15 Claims, 3 Drawing Sheets

Figure 1:
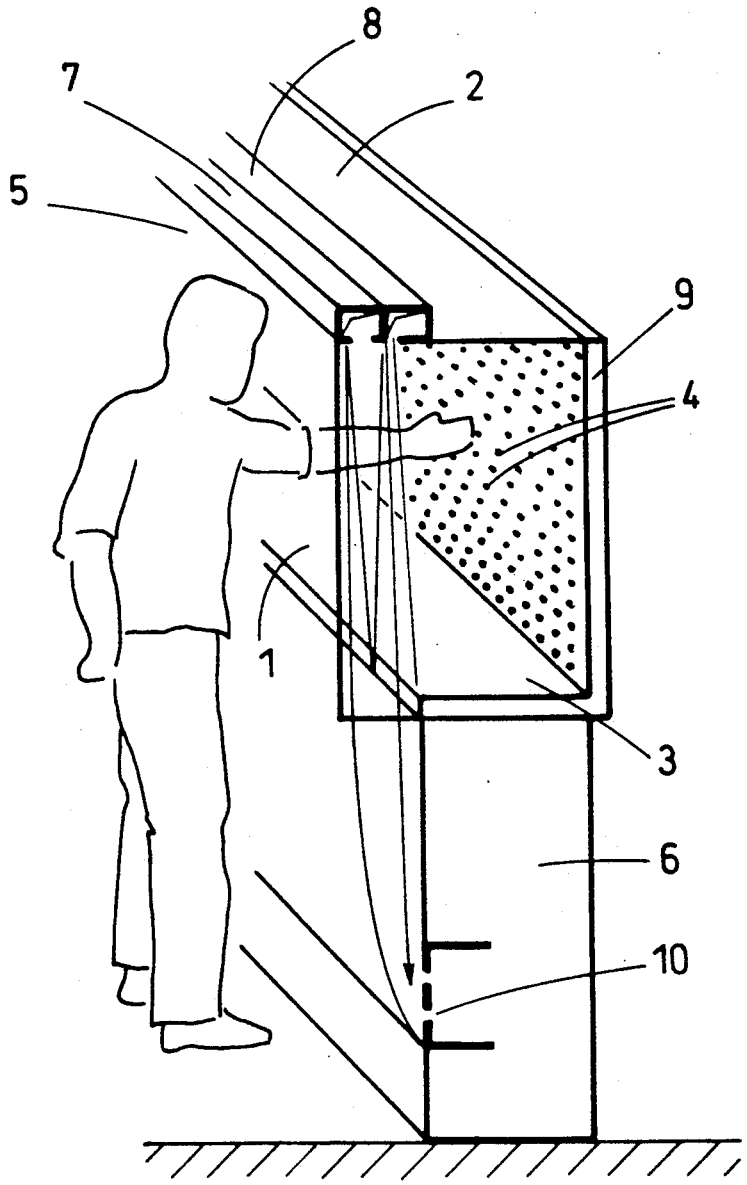

METHOD AND DEVICE FOR MAINTAINING A CLEAN ATMOSPHERE AT CONTROLLED TEMPERATURE AT A WORKSTATION

The invention relates to a method and device for maintaining a clean atmosphere at controlled temperature at a workstation, accessible from a contaminated room.

The problem of maintaining a clean atmosphere at a workstation arises for example, in the agri-foodstuffs industry.

For packaging products (for example: bottling, packing of cooked dishes in vinyl, . . . ), it is necessary to work in a very clean atmosphere: the maximum acceptable concentrations of particulate and microbiological contaminants, fixed by regulations, must not be exceeded.

Moreover, to avoid the proliferation of microorganisms, the work is normally conducted in a cold atmosphere.

Therefore, the workstations should be isolated from:

particulate, microbiological and gas pollution, heat transfers, while leaving a free access thereof to the operators.

Heretofore, operators have been working in so-called "white rooms". All the air in these rooms is treated so as to bring the concentrations in contaminants to below acceptable thresholds. Also, the temperature of the air in such rooms is controlled. The required ventilation system is important and especially costly. The working conditions are also unpleasant for the staff, and in particular the temperature conditions.

To prevent such disadvantages, the Applicant has sought to isolate workstations from the air in the room where the operators are; the air in that room no longer requiring the "white room" treatment.

Already, in the nuclear field, it is known to confine the pollution of a room by using a curtain of air (French Patent Application 82/12382 published under No. 2 530 163).

According to this technique, a contaminated zone is isolated from the outside (clean zone) by placing on the opening of the room two air-injecting nozzles creating two air jets:

a first jet situated on the contaminated zone side; this jet comprises a potential flowing zone (inner cone) whose range is at least equal to one of the dimensions of the opening; the jet spreading also over the entire other dimension in order to cover the opening; which implies an injection nozzle of great width; (this first jet constitutes the confinement barrier);

a second jet situated on the clean zone side (outside), which is parallel and has the same direction as the first jet, and such that the air flowrate induced by its inner face in contact with the first jet is equal to the flowrate of said first jet (this second jet stabilizes the first).

In the present description:

slow jet will designate the first jet;

fast jet, the second jet;

inner cone, the potential flowing zone;

width, the dimension (of the opening or of the jets) parallel to the flowing direction of the curtain;

length the dimension (of the opening or of the jets) perpendicular to the flowing direction of the curtain.

This technique makes it possible to isolate a room from pollution and to prevent heat transfers, but it must be adapted so as to give the operator access to a workstation situated inside such room.

Thus, the present invention provides a method and device which improve the object of French Patent Application No. 82/12382 (published under No. 2 530 163) for maintaining a clean atmosphere at a workstation (internal), although the curtain of air is traversed by an obstacle (such as for example, the operator situated outside thereof).

The invention is not limited to air atmospheres in which men work; it can be applied to any gaseous atmosphere, since the work can be done by robot, remote handling, etc.

More specifically, the invention resides in a method for maintaining a clean atmosphere at controlled temperature at a workstation, said workstation being accessible from a contaminated zone through at least one opening, method in which a curtain of gas is generated at the level of said opening in the form of a slow jet and a fast jet, the slow jet having an inner cone of range at least equal to the width of the opening, the fast jet having a flowrate induced by its internal face in contact with the slow jet equal to the injection flowrate of the slow jet, and the two jets covering the whole length of the opening, method wherein, in characteristic manner:

the fast jet is situated at the level of the opening on the workstation side (in the clean zone), said jets are directed approximately in parallel to the openings such that at least the external face of the fast jet reaches up to said opening, a stream of clean gas is generated on the workstation under a controlled temperature, directed in such a way as to oppose the entry of the contaminants and to sweep uniformly over the workstation, the flowrate of said current being at least equal to the flowrate supplying the external face of the fast jet, if necessary, the gas blown-in as one or more jets and as a current is sucked in at the level of the opening and in facing relationship to the injection zone.

The workstation is generally isolated from the contaminated zone by one or more walls and a curtain of gas at the level of each opening on the contaminated zone. The volume thus defined, inside which is situated the workstation, constitutes the volume to be kept clean.

In practice, an enclosure, equipped with walls, is generally placed around the workstation; the enclosure communicates with the outside, to allow the operator to reach the workstation, through at least one opening.

The enclosure may have various shapes, as will be illustrated hereinafter in the figures (parallelepipedal, bell-like, . . . ). The volume to be kept clean (the atmosphere of the enclosure) is isolated from the outside (contaminated zone), and kept clean and at a controlled temperature, by means of:

a curtain of gas according to Patent Application FR 82/12382 (published under No. 2 530 163): the fast jet is situated at the level of the opening on the clean zone side, the slow jet being on the contaminated zone side, a stream of clean gas flowing into the volume to be protected and sent in such a way as to sweep over the whole volume uniformly.

To form the curtain, the gases can be injected from any side of the opening. Preferably, they are injected downwards from the top.

The jets are sent in such a way that at least the external face of the fast jet (that which is not in contact with the slow jet) reaches up to the plane of the opening.

Indeed, the external face of the fast jet must not be too far from the opening, as this would clear an unprotected space between the workstation and the jet, through which space contamination could enter.

The external face can advantageously reach just to the level of the opening. In such a case the gas curtain encounters no obstacle and obstructs completely said opening.

The external face can reach inside the volume or enclosure to be kept clean. In such a case, the fast jet, and possibly also the slow jet, encounter a surface, which faces their injection zone. Said surface can be the workstation. It can also be the floor of the enclosure. Then suction means should be provided at the level of said surface so that said jets are not perturbed.

When the curtain of gas is delimited lengthwise, the two walls of the opening which are perpendicular to the flowing path of the jets are extended beyond the plane of the opening over a distance at least equal to the thickness of the curtain at the level of its effective range (i.e. at the level of its end).

When the curtain of gas has a continuous shape, such as for example a circular shape, obviously it does not need to be delimited.

The speed of the slow jet is selected so as to restrict turbulences in the presence of an obstacle. It is generally between 0.4 and 0.6 m/sec, and more broadly $<0.6$ m/sec.

The flowrate of the stream of clean gas is at least equal to the flowrate induced by the external face of the fast jet.

Its direction when delivered is such that it prevents the contaminants from entering and spreading into the volume to be protected, and that it ensures sweeping of the workstation.

According to a preferred embodiment of the invention, the stream of clean gas is directed perpendicularly to the plane of the opening; therefore, when the workstation is situated inside an enclosure, this stream is delivered from the wall of the enclosure which faces the opening protected by the curtain of gas. This stream is also directed from the zone to be kept clean towards the contaminated zone (outside).

A laminar flow is then created in the volume to be protected, which flow ensures the non-diffusion of the contaminants.

According to another embodiment, the stream of clean gas is sent in the same direction as the curtain of gas and approximately in parallel thereto.

The temperature of the stream of clean gas is selected by the industrialist as a function of his requirements.

The stream of clean gas contributes, in combination with the curtain of gas, to isolating the volume to be protected (in the enclosure) against thermal changes and pollution.

It ensures heat control of the volume to be protected and the cleanliness of the workstation.

In the absence of obstacle traversing the curtain of gas, the inner cone of the slow jet constitutes a barrier against the contaminants because the speed vectors are parallel and equal. However, there occurs a slight retrodiffusion of the polluted gas due to the jet being perturbed by the walls limiting its length.

In the presence of a clean obstacle (such as for example the gloved arm of an operator) traversing the curtain of gas, the inner cone which acts as a barrier is affected.

The obstacle then constitutes a local source of retrodiffusion of the contaminants.

The major part of this diffusion is picked up by:

the fast jet which immediately removes a large part of the contaminants;

the stream of clean gas which sweeps away the contaminants which, through turbulent diffusion, may have escaped from the external face of the fast jet and reach the enclosure. The selected directions, indicated hereinabove, for delivering said stream makes it possible to arrive at this result.

The existence of the stream of gas (inside the enclosure or inside the volume to be protected), controlled so as to reach the required temperature which will prevent the concentration gradient, also opposes the heat gradient.

A suction of the gas from the jets beyond the opening, is preferably provided, particularly when the external face of the fast jet reaches to the limit of the workstation, so as to control ventilation in the contaminated zone.

A further object of the invention is a device for carrying out the aforesaid method.

Said device comprises:

an enclosure inside which is located a workstation; said workstation being accessible from the outside through at least one opening of said enclosure;

two nozzles placed side by side, on one side of said opening for injecting gas in the form of jets; the length of the nozzles being equal to that of the opening, the size of the hole in each nozzle being determined as a function of the speed and range of the jet to be obtained, and the orientation of the nozzles being so determined that at least the external face of the fast jet reaches to the level of said opening;

at least one means for injecting the stream of clean gas; said means being selected and disposed so that the gas is uniformly distributed in the volume of the enclosure (to be protected) and in such a way that the stream of clean gas arrives approximately in a direction perpendicular or parallel to the plane of said opening;

pipe systems and means for supplying gas to said nozzles and to said means for injecting the stream of clean gas;

optionally, a suction device for sucking in the gases blown-in in the form of jets and stream inside said enclosure.

Generally, the workstation constitutes the floor of said enclosure.

According to a first variant, said enclosure is parallelepipedal. It comprises at least two lateral walls for limiting the length of the curtain of gas and for preventing the turbulence of the jets. Said lateral walls, which are perpendicular to the flowing path of said jets, are extended, beyond the opening over a distance at least equal to the thickness of the jets at the level of their effective range.

If said parallelepipedal enclosure comprises a lateral wall opposite the opening, the means for injecting the stream of clean gas is advantageously constituted by said wall, which is perforated (thereby acting as a diffusing wall) and supplied with said clean gas (for example, from a tank which covers the entire surface of the wall, in which said gas arrives under slight excess pressure). In this case, the stream of clean gas arrives approximately in a direction perpendicular to the jets, sent by the nozzles.

This embodiment of the invention is illustrated in FIG. 1.

Figure 3:
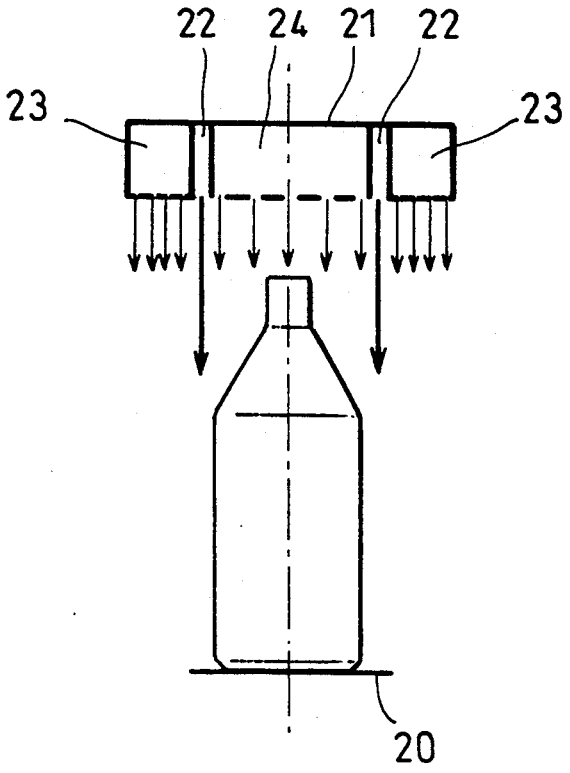

According to another embodiment, notably when said enclosure has no lateral wall facing the opening, in effect, when said enclosure has two lateral walls facing each other and two openings facing each other, the means for injecting the stream of clean gas is constituted by the wall on which are fixed the nozzles, said wall being perforated and fed with gas in order to act as a diffusing wall. In this case, the stream of clean gas is virtually parallel to the jets issued from the nozzles. This embodiment is illustrated in FIG. 3.

According to another variant of the device of the invention, said enclosure does not comprise a lateral wall but an opening over its entire periphery. It is for example bell-shaped.

The means for injecting the stream of clean gas is, in this case, advantageously constituted by a plurality of nozzles situated at the top of the ceiling (of the bell) and oriented so as to distribute the gas along the walls of the ceiling and into the enclosure.

There are, in this case, a stream of clean gas which is approximately parallel to the jets issued from the nozzles (said stream flowing along the walls of the bell) and a stream of clean gas reaching virtually perpendicularly to the jets issued from the nozzles (that is the stream resulting from the injection into the enclosure).

Figure 2A:
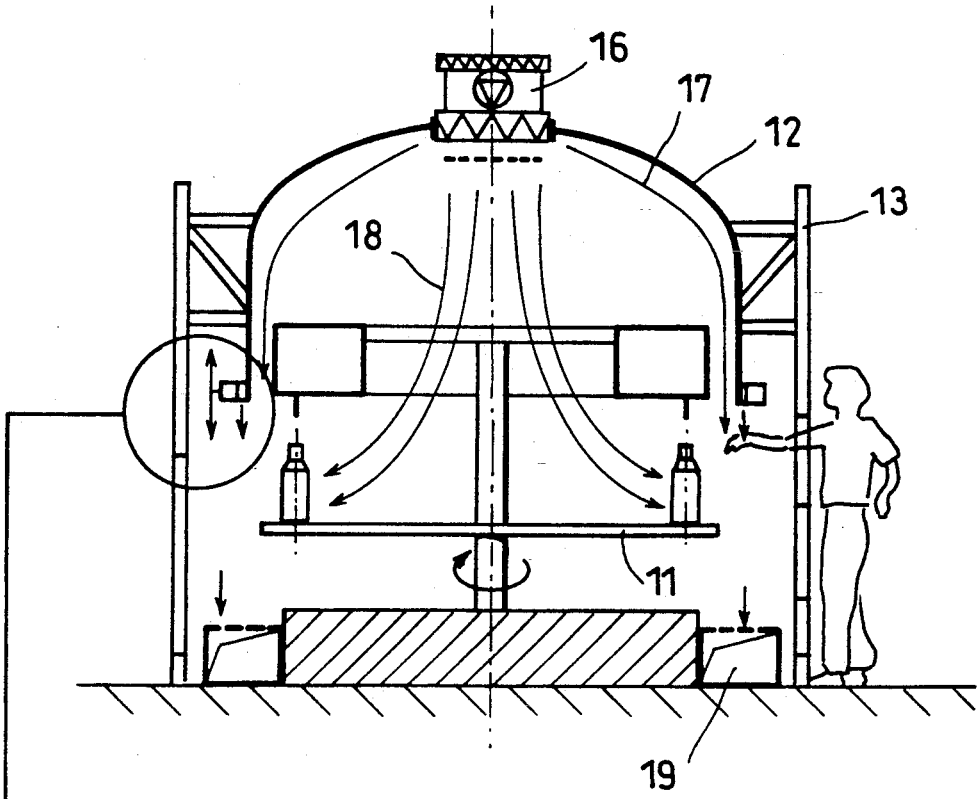
Figure 2B:
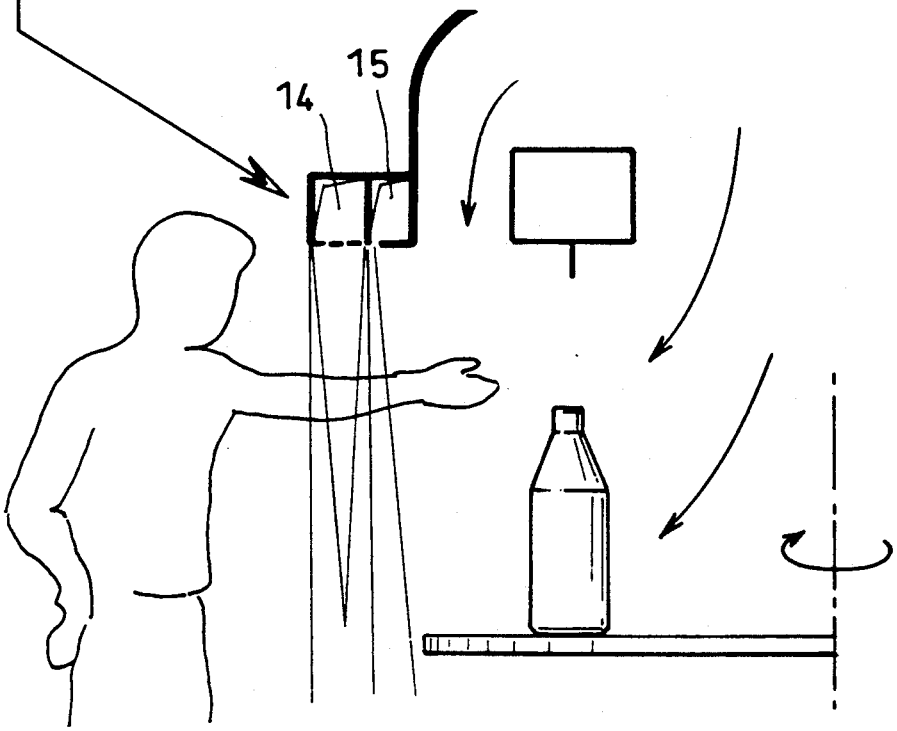

This variant of the device of the invention is illustrated in FIGS. 2A-2B.

It is to be understood that the terms "parallel" and "perpendicular" as used for the directions of the jets and of the streams of gas are very approximate.

The nozzles are of course associated to distribution tanks equipped with any device permitting an equal distribution of the flow over the whole section of the nozzles.

Advantageously, the nozzles are oriented in such a way that the external face of the fast jet reaches just to the level of the opening.

In such a case, the gases are oriented outwardly from the enclosure and there is no need to provide a suction device therein. Nevertheless, in this case, a suction hole for sucking in the gases, can be advantageously provided, outside the enclosure, in the contaminated zone, in order to control the ventilation in said zone.

When the external face of the fast jet reaches inside the enclosure, it is then necessary to provide a suction device for sucking in the gases blown-in in the form of a jet or jets, and of a stream, inside said enclosure.

The invention will be illustrated by the following figures:

FIGS. 1 to 3 show three embodiments of the invention:

FIG. 1: a workstation for packing low-mobility products;

FIGS. 2A and 2B: a workstation for bottling liquid foodstuffs, the bottles being mobile;

FIG. 3: a conveyor line for clean bottles.

According to FIG. 1, the workstation 1 is a horizontal working surface, around which has been built a parallelepipedal enclosure having a ceiling 2 and three lateral walls (only two of which are shown, referenced 3 and 4), wall 4 facing the opening 5, wall 3 being extended beyond the nozzles 7 and 8 over a distance at least equal to the thickness of the curtain of gas at the level of the workstation. Said wall is transparent in FIG. 1.

Said enclosure rests on the ground via the support 6.

On the ceiling side of the opening are provided two nozzles 7 and 8 for injecting gas (in this case, air) brought by a pipe system not shown. Nozzle 7 diffuses the slow jet, nozzle 8 the fast jet.

The flowrates and speeds (dimensions of the holes) are adjusted so as to obtain a so-called slow jet on the outside and a so-called fast jet on the enclosure side.

The nozzles 7 and 8 can be inclined if need be, so that the jets advantageously reach the limit of the working surface 1, without being in contact with it and without being too remote therefrom (in order to prevent the outside contamination from reaching the enclosure from beneath the working surface).

To create the stream of clean gas with a diffusing wall, the wall 4 opposite the opening 5 is provided over its entire surface with perforations, preferably uniformly distributed. Behind said wall, there is provided a means permitting a uniform distribution of the gas over the wall surface, such as for example a tank 9 covering the whole surface of the wall, and into which the gas is brought, which gas thereafter traverses the wall through the perforations and spreads into the enclosure.

A suction hole for sucking in the gases 10 is provided at the bottom of the support 6 (in the contaminated zone) for creating a controlled flow of air.

Such an enclosure, equipped with means according to the invention, is particularly adapted for treating products to be packed, which products are brought by the operator or travel at slow speed on a conveyor.

FIGS. 2A and 2B show a workstation 11 constituted by a horizontal plane which, in this particular case, is a table turning about a central shaft. This type of workstation is found in bottling plants where the bottles are brought automatically on the table, filled at one station and directed away from said table towards other stations.

A bell-shaped enclosure 12 is placed above the table 11 and supported by posts 13. Advantageously, said enclosure can be mounted or lowered at will.

Two adjacent nozzles 14 and 15 are mounted at the level of the plane of opening of the enclosure and over the whole periphery thereof, in order to create the curtain of gas (which in this case is air). The flow speeds and rates being controlled to form said curtain, the so-called slow jet being delivered by the nozzle 14 and the so-called fast jet by the nozzle 15.

At the top part of the ceiling (or bell 12), a plurality of nozzles 16 are provided for creating a stream of clean gas 17 which follows the walls of the bell as well as a gaseous sweeping stream 18 which spreads towards the center of the rotating table, which is distributed inside the enclosure and which is sucked in again by the fast jet. Thus, its curve is such that it reaches the curtain of gas in substantially perpendicular manner.

A suction orifice 19 is placed on the ground beneath the nozzles 14, 15.

FIG. 3 shows a conveyor line 20 protected -from the outside, on which line are conveyed the bottles to be kept Clean.

The enclosure is composed of a floor 20—the conveyor (workstation)—and of a ceiling 21, constituted in this case by the tanks supplied with gas and containing the injection nozzles. The lateral walls of the enclosure are extended at the end of the conveyor and not shown.

From the symmetrical tanks 22, symmetrical fast jets are sent over at least the whole length of the conveyor line and over at least its whole opening width. The distance between the tanks and the conveyor constituting the opening of the enclosure.

The external face of the fast jets (on the bottle side) reaches to the limit of the conveyor line 20 constituting the workstation and as close as possible to the bottles.

From the symmetrical tanks 23, slow jets are sent over at least the entire length of the conveyor line and over at least its entire width, the inner cone of each one of the jets being controlled so that its range is equal to the width of the opening.

The slow speed stream of clean gas is sent from the central tank 24. It covers the entire volume of the enclosure and is sent parallely to the two curtains of gas.

The above-described figures do not in any way limit the invention, of which the field of application is not limited to the agri-foodstuffs industry.

By way of example, a workstation situated inside an enclosure such as that shown in FIG. 11, has been isolated, with:

length of the opening=1.20 m
width of the opening=0.80 m
depth of the enclosure=0.70 m.
The following dimensions have been given to:
the fast jet hole=6 mm
the slow jet hole=200 mm (both these holes being inclined of 12° with respect to the vertical, towards the outside)
the fast jet flowrate=100 m3/hr
the slow jet flowrate=400 m3/hr
the slow jet inner cone speed=0.4 m/sec.
the fast jet speed=4 m/sec.
the flowrate of the stream of clean gas=470 m3/hr.
the speed of the stream of clean gas=0.15 m/sec.
the temperature of the enclosure=+3° C.

I claim:

1. A method of maintaining a clean atmosphere at controlled temperature at a workstation (1), said workstation (1) being accessible from a zone containing contaminants through at least one opening (5), said opening having a width and a length, which comprises generating a curtain of gas at the level of said opening (5) by means of a slow jet and a fast jet, the slow jet having an inner cone of range equal to the width of said opening (5), said slow jet having a flow rate, said fast jet having an external face, an internal face and a flow rate, said internal face being in contact with the slow jet, said flow rate of said fast jet being induced by said internal face and being equal to the injection flow rate of said slow jet, said slow jet and said fast jet covering the entire length of said opening (5), said fast jet being situated at the level of said opening (5) on the workstation side (1), said slow jet and fast jet being directed approximately in parallel to the opening (5) whereby at least said external face of the fast jet reaches up to said opening (5), and generating a stream of clean gas on the workstation (1) under a controlled temperature, in a direction opposite to the entry of said contaminants, said stream of clean gas sweeping uniformly over said workstation (1), the flowrate of said stream being at least equal to the flowrate induced by said external face of the fast jet.

2. The method according to claim 1, wherein the flow rate of said slow jet is between 0.4 and 0.6 m/sec.

3. The method according to claim 1, wherein said opening (5) is in a plane, the stream of clean gas is sent in a direction perpendicular to said plane of said opening (5), and from the volume to be kept clean towards the zone containing said contaminants.

4. The method according to claim 1, wherein said opening (5) is in a plane, the stream of clean gas is sent in a direction substantially parallel to said plane of said opening (5) and in the same direction as said slow jet and said fast jet.

5. A device for maintaining a clean atmosphere at a workstation, said workstation being accessible from a zone containing contaminants, which comprises:

an enclosure, said workstation (1) being located in said enclosure, said enclosure having at least one opening (5), said opening being in a plane, said workstation (1) being accessible from the outside through at least said one opening (5);

two nozzles (7,8) placed side by side, on one side of said opening (5) for injecting gas in the form of one fast jet and one slow jet; the length of the nozzles (7,8) being equal to that of said opening (5), each nozzle having an orifice, the size of said orifice in each nozzle (7,8) being determined as a function of the flow rate and of the range of the jet to be obtained, means for supplying the nozzles with gas, said fast jet having an external face, said nozzles (7,8) being oriented so that at least said external face of the fast jet reaches the level of said opening (5), at least one means (9) for injecting a stream of clean gas, said means (9) being selected and disposed so that the clean gas is uniformly distributed in said enclosure and in such a way that the stream of clean gas arrives approximately in a predetermined direction with respect to said plane of said opening (5), and a suction device for sucking in the gases blown-in in the form of said jets and of a stream, inside said enclosure.

6. The device according to claim 5, wherein said stream of clean gas arrives in a direction perpendicular to the plane of the opening.

7. The device according to claim 5, wherein said stream of clean gas arrives in a direction parallel to the plane of the opening.

8. The device according to claim 5, wherein the workstation (1) constitutes the floor of said enclosure.

9. The device according to claim 5, wherein said enclosure comprises at least two lateral walls, perpendicular to the flow path of said jets and extended beyond said opening (5) over a distance at least equal to the thickness of said jets at the level of their effective range.

10. The device according to claim 9, wherein said enclosure has a perforated rear wall (4) facing said opening (5) and said perforated rear wall (4) is a diffusing wall for the current of clean gas.

11. The device according to claim 9, wherein the wall (21) on which are fixed the nozzle is a perforated diffusing wall for the stream of clean gas.

12. The device according to claim 5, wherein said enclosure is bell-shaped enclosure (12), the workstation is a table, the enclosure has at its top nozzles (16) for injecting clean gas along the walls of said bell enclosure.

13. The device according to claim 12, which comprises a suction opening (19) for sucking in the gases, situated in the contaminated zone, under said nozzles.

14. The device according to claim 5, which comprises an opening (10) at the bottom thereof for sucking in said gases.

15. The device according to claim 5, wherein said enclosure comprises a floor (20), a workstation in the form of a conveyor and a ceiling (21), said ceiling being constituted by tanks, said tanks supplying gas to a plurality of parallel fast jets and slow jets, and a central tank supplying said stream of clean gas parallel to said slow jets and said fast jets.

* * * * *